US009689388B2

(12) United States Patent
Choi et al.

(10) Patent No.: US 9,689,388 B2
(45) Date of Patent: Jun. 27, 2017

(54) SCROLL COMPRESSOR

(71) Applicant: LG ELECTRONICS INC., Seoul (KR)

(72) Inventors: Yoonsung Choi, Seoul (KR); Byungkil Yoo, Seoul (KR); Seheon Choi, Seoul (KR); Jinho Kim, Seoul (KR); Chuljig Bae, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 149 days.

(21) Appl. No.: 14/782,393

(22) PCT Filed: Jun. 2, 2014

(86) PCT No.: PCT/KR2014/004900
§ 371 (c)(1),
(2) Date: Oct. 5, 2015

(87) PCT Pub. No.: WO2014/196774
PCT Pub. Date: Dec. 11, 2014

(65) Prior Publication Data

US 2016/0061203 A1 Mar. 3, 2016

(30) Foreign Application Priority Data

Jun. 5, 2013 (KR) ..... 10-2013-0064757
May 19, 2014 (KR) ..... 10-2014-0059890

(51) Int. Cl.
*F01C 21/10* (2006.01)
*F04C 23/00* (2006.01)
(Continued)

(52) U.S. Cl.
CPC ..... *F04C 23/005* (2013.01); *F04C 18/0215* (2013.01); *F04C 18/0253* (2013.01);
(Continued)

(58) Field of Classification Search
CPC ..... F04C 18/0215; F04C 18/0253; F04C 18/3564; F04C 2240/56; F04C 23/005;
(Continued)

(56) References Cited

U.S. PATENT DOCUMENTS 4,637,786 A * 1/1987 Matoba ..... F01C 17/066 418/55.3
5,011,384 A 4/1991 Grunwald et al.
(Continued)

FOREIGN PATENT DOCUMENTS

CN 1616828 5/2005
CN 101089395 12/2007
(Continued)

OTHER PUBLICATIONS

Korean Notice of Allowance dated Jul. 1, 2016.
(Continued)

*Primary Examiner* — Jesse Bogue
(74) *Attorney, Agent, or Firm* — Ked & Associates LLP

(57) ABSTRACT

A compressor according to the present disclosure may include a container; a drive motor provided in the container; a crankshaft coupled to a rotor of the drive motor; a first scroll coupled to the crankshaft to receive a rotational force of the drive motor to perform an orbiting movement; a second scroll coupled to the first scroll to form a first compression unit and a second compression unit along with the first scroll; and a vane provided in the first scroll or second scroll to be brought into contact with the other side scroll to form the second compression unit, wherein the first compression unit is carried out in a scroll compression mode and the second compression unit is carried out in a rotary compression mode.

19 Claims, 10 Drawing Sheets

(51) Int. Cl.

| | |
|---|---|
| ***F04C 18/02*** | (2006.01) |
| ***F04C 18/356*** | (2006.01) |
| ***F04C 29/00*** | (2006.01) |
| ***F04C 29/12*** | (2006.01) |

(52) U.S. Cl.
CPC ..... *F04C 18/3564* (2013.01); *F04C 29/0057* (2013.01); *F04C 29/12* (2013.01); *F04C 23/008* (2013.01); *F04C 2240/56* (2013.01); *F05C 2225/00* (2013.01)

(58) Field of Classification Search
CPC .... F04C 23/008; F04C 29/0057; F04C 29/12; F05C 2225/00
See application file for complete search history.

(56) References Cited

U.S. PATENT DOCUMENTS

| | | | | |
|---|---|---|---|---|
| 5,304,047 | A | 4/1994 | Shibamoto | |
| 6,638,040 | B2 | 10/2003 | Wang et al. | |
| 2003/0124011 | A1 | 7/2003 | Wang et al. | |
| 2006/0078451 | A1 | 4/2006 | Kim et al. | |
| 2009/0104060 | A1* | 4/2009 | Sato | F04C 18/0215 418/5 |
| 2013/0089450 | A1* | 4/2013 | Earmme | F01C 17/066 418/55.3 |
| 2015/0369243 | A1* | 12/2015 | Beez | F01C 17/06 418/55.3 |

FOREIGN PATENT DOCUMENTS

| | | |
|---|---|---|
| JP | S61-11488 A | 1/1986 |
| JP | 63-9692 | 1/1988 |
| KR | 10-0135416 | 4/1998 |
| KR | 10-2006-0031122 | 4/2006 |

OTHER PUBLICATIONS

Chinese Office Action dated Aug. 15, 2016. (Translation).
International Search Report and Written Opinion issued in Application No. PCT/KR2014/004900 dated Sep. 29, 2014.

* cited by examiner

[Fig. 1]
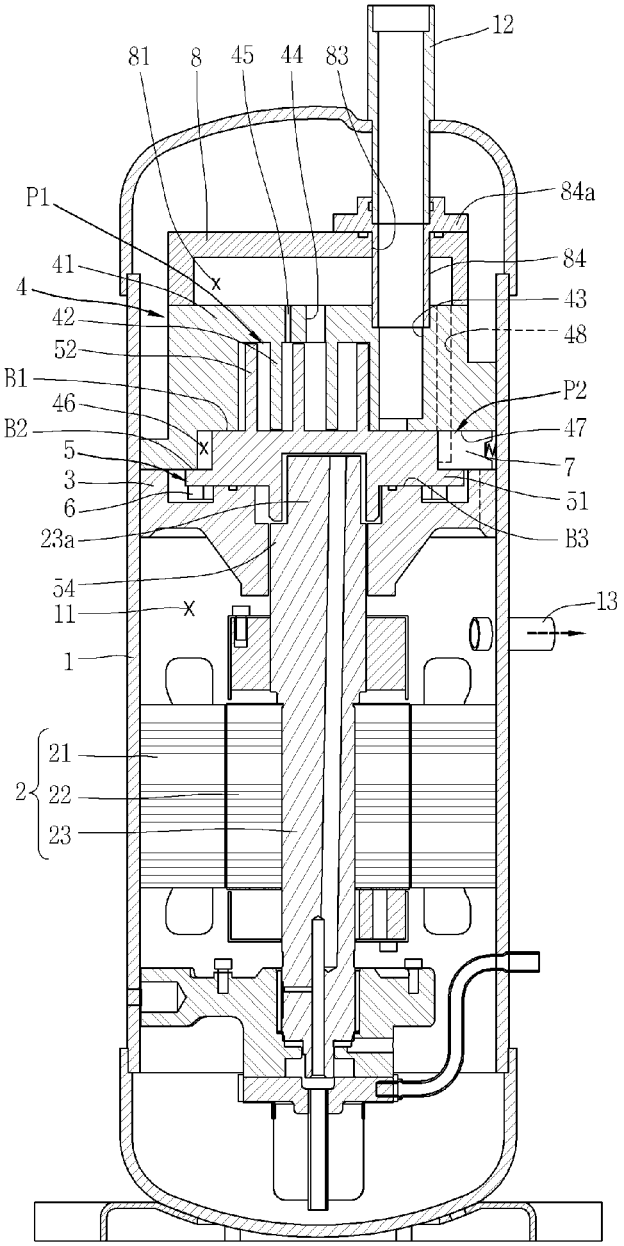

[Fig. 2]
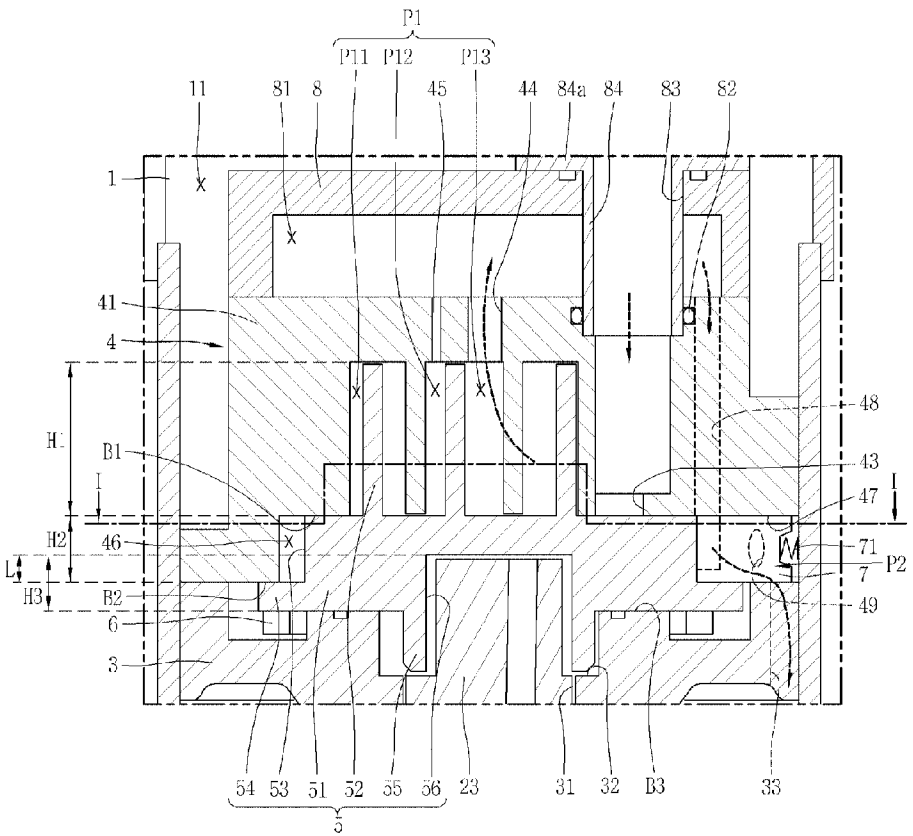
[Fig. 3]
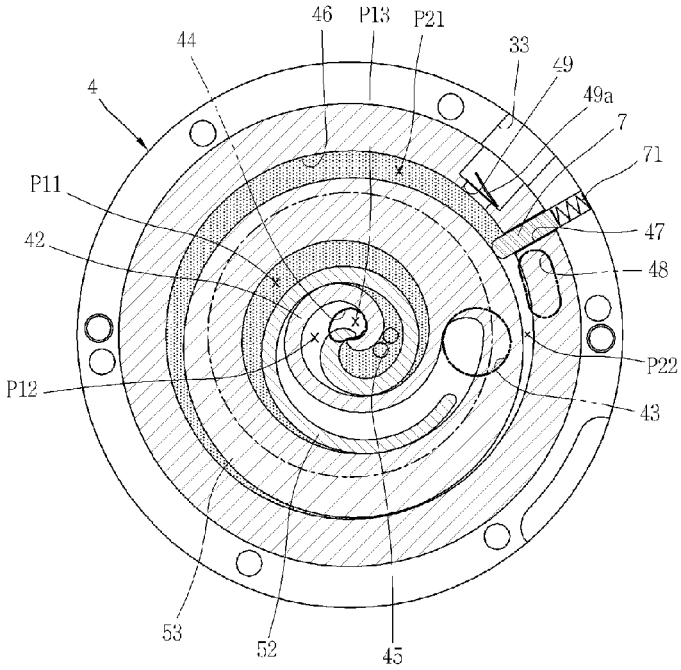

[Fig. 4]
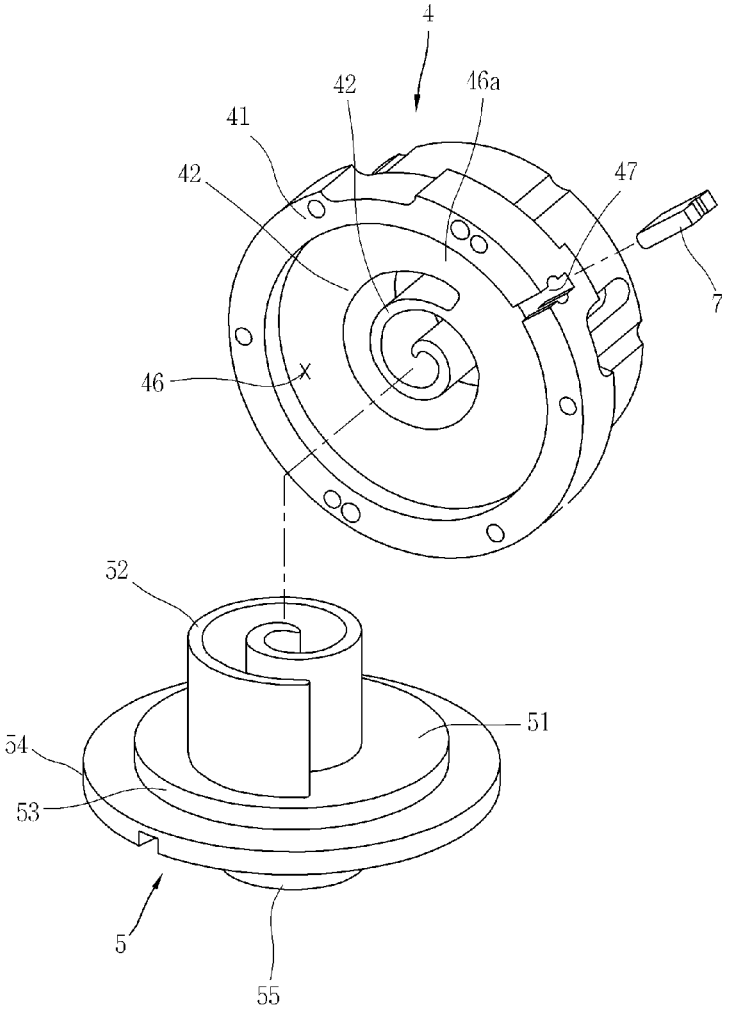

[Fig. 5]
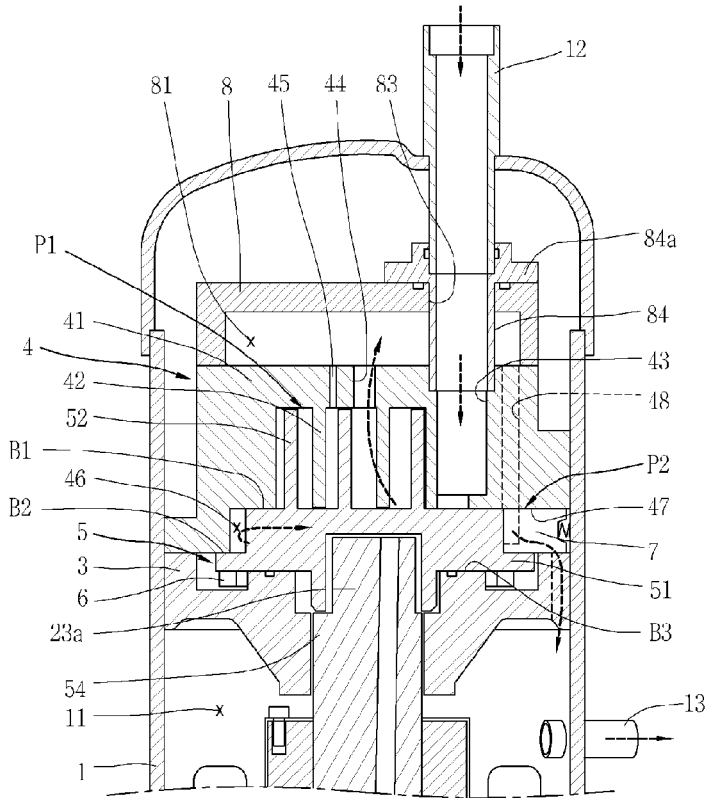
[Fig. 6]
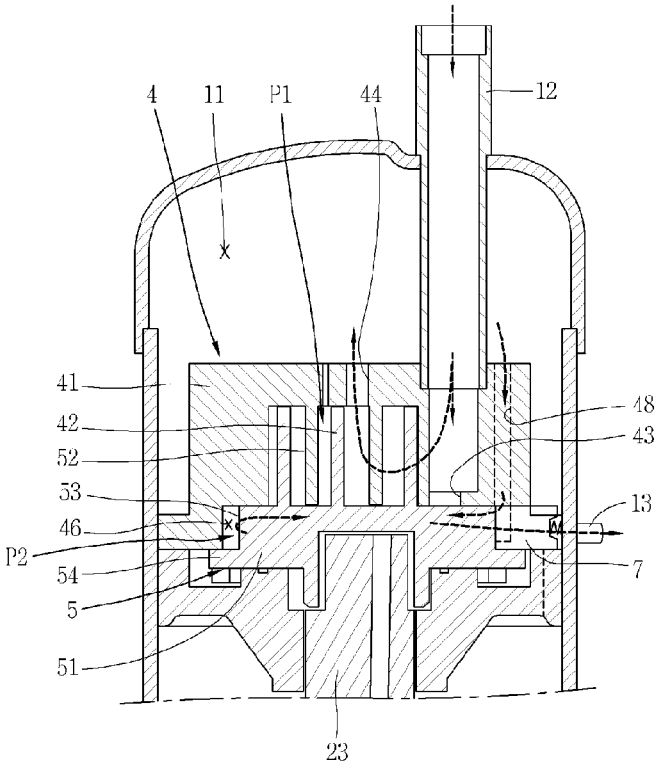

[Fig. 7]
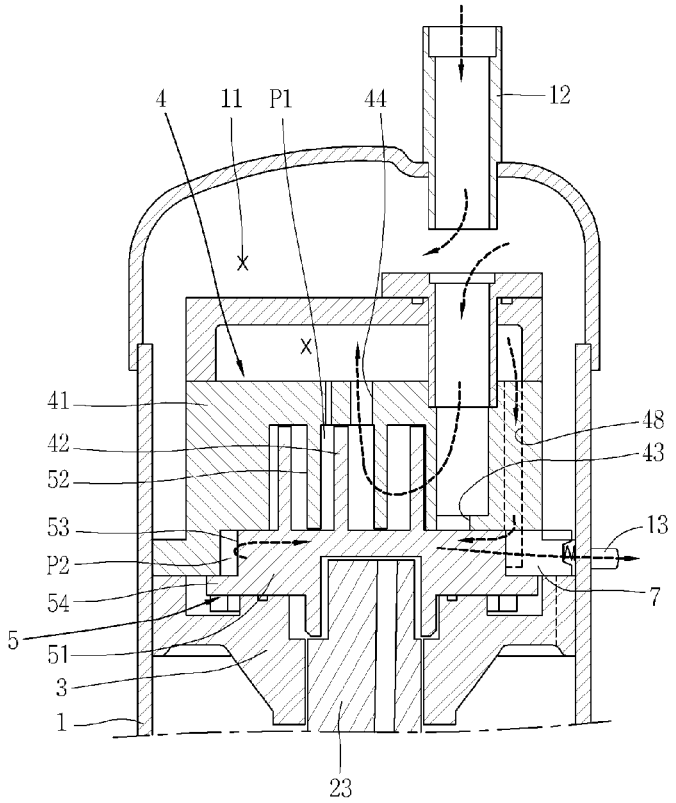
[Fig. 8]
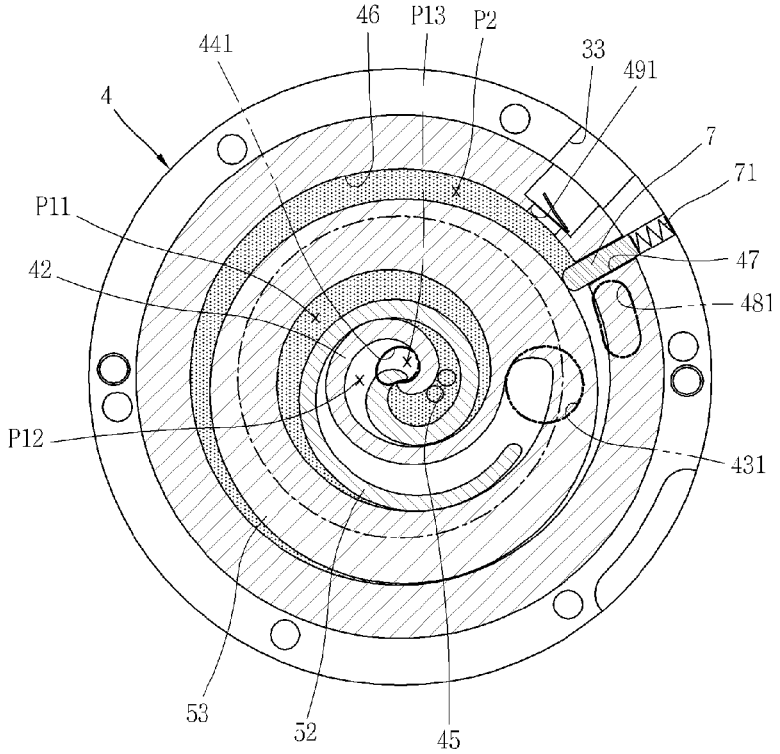

[Fig. 9]
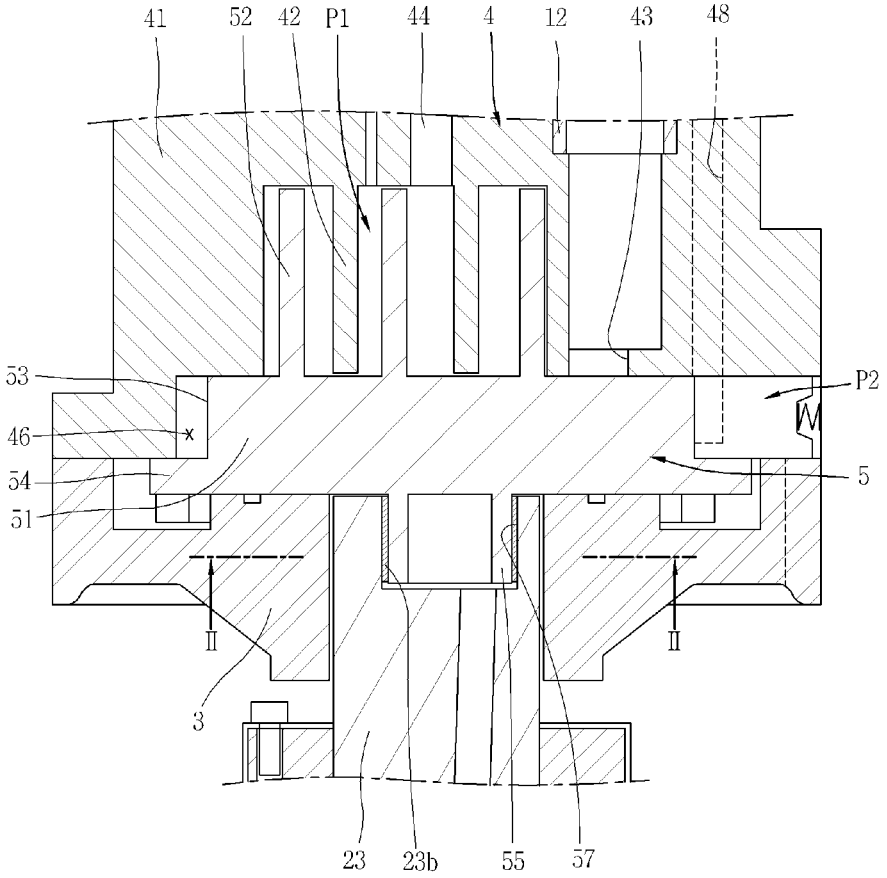
[Fig. 10]
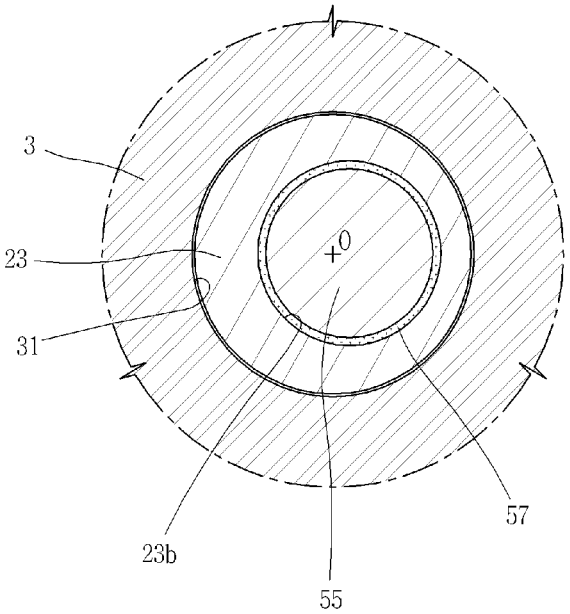

[Fig. 11]
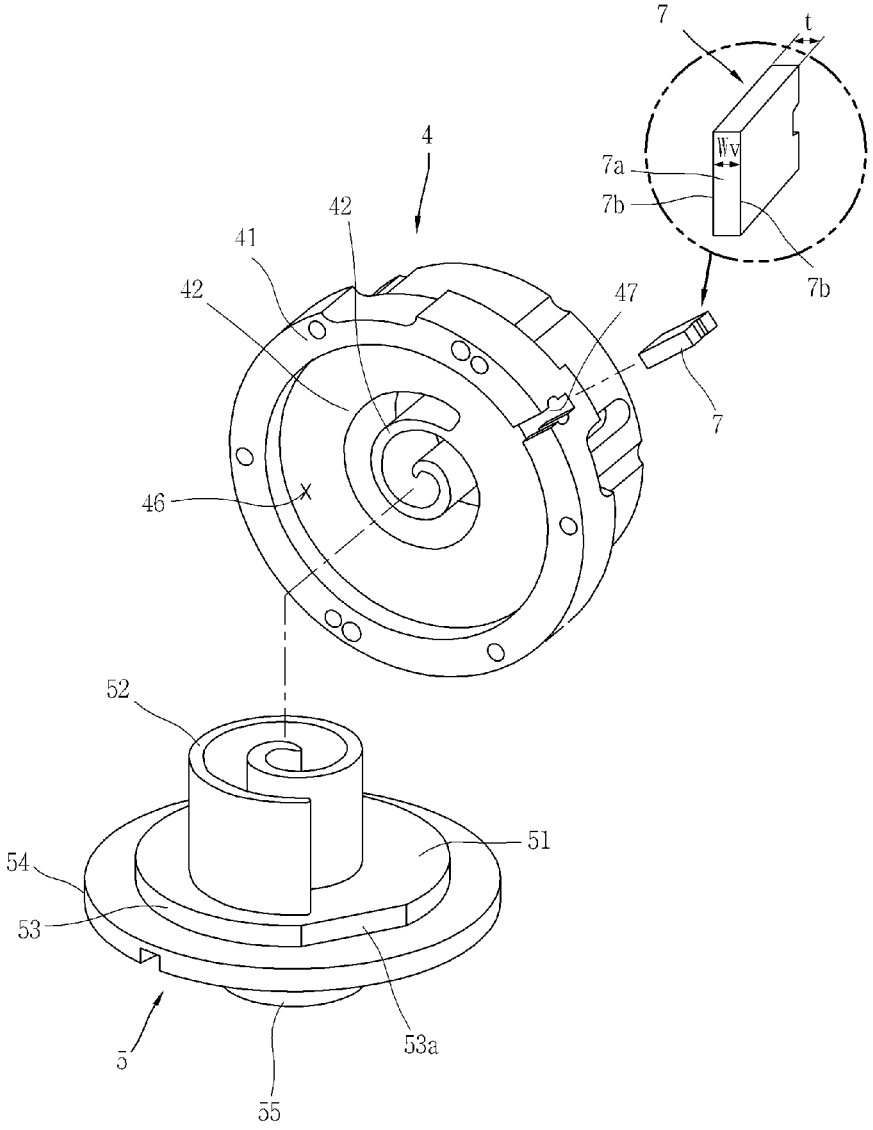

[Fig. 12]
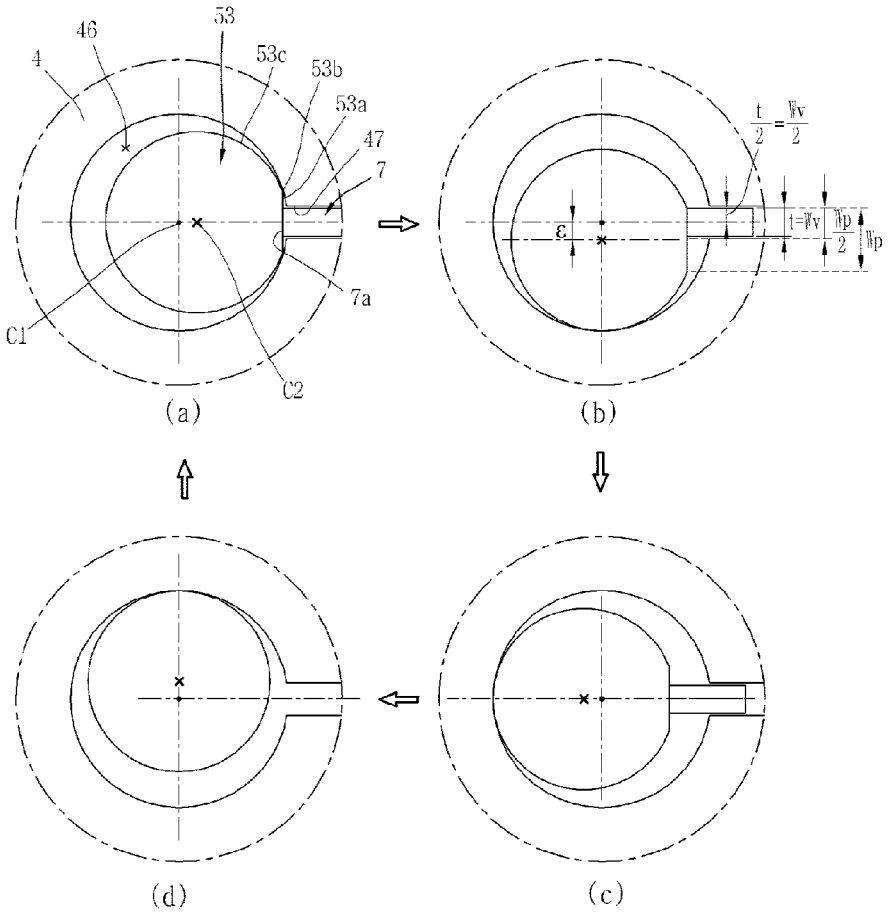
[Fig. 13]
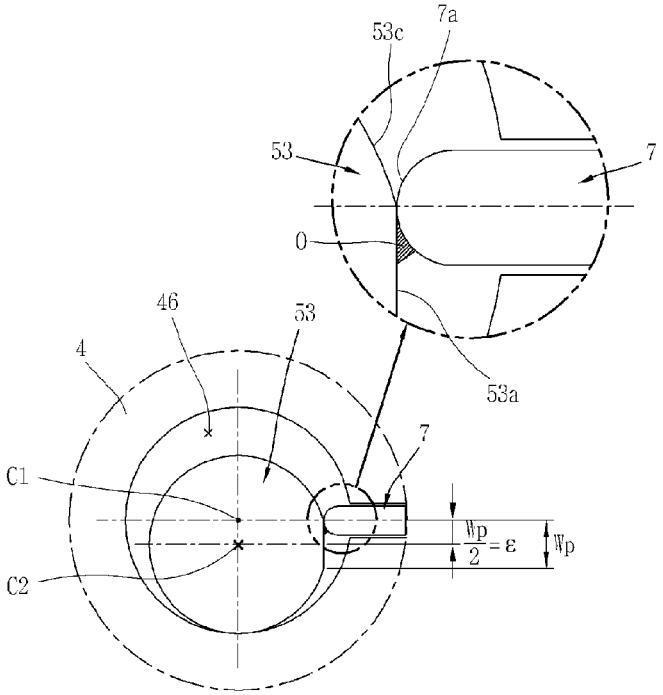

[Fig. 14]
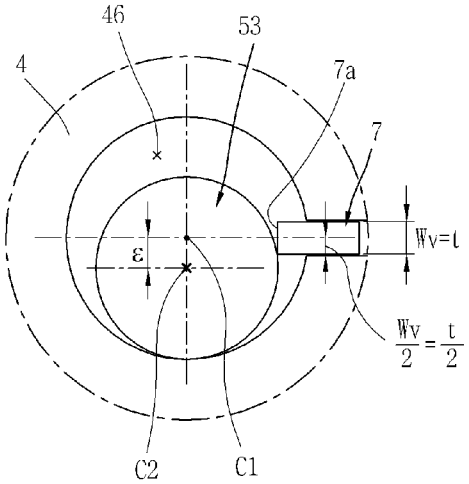
[Fig. 15]
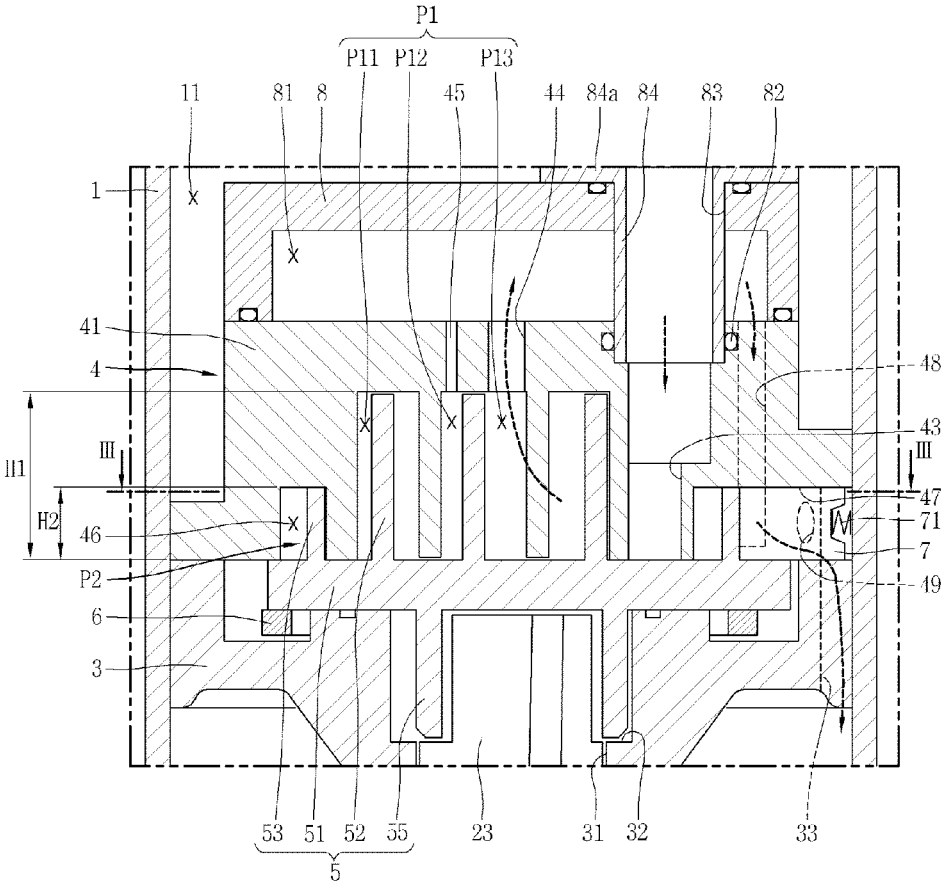

[Fig. 16]
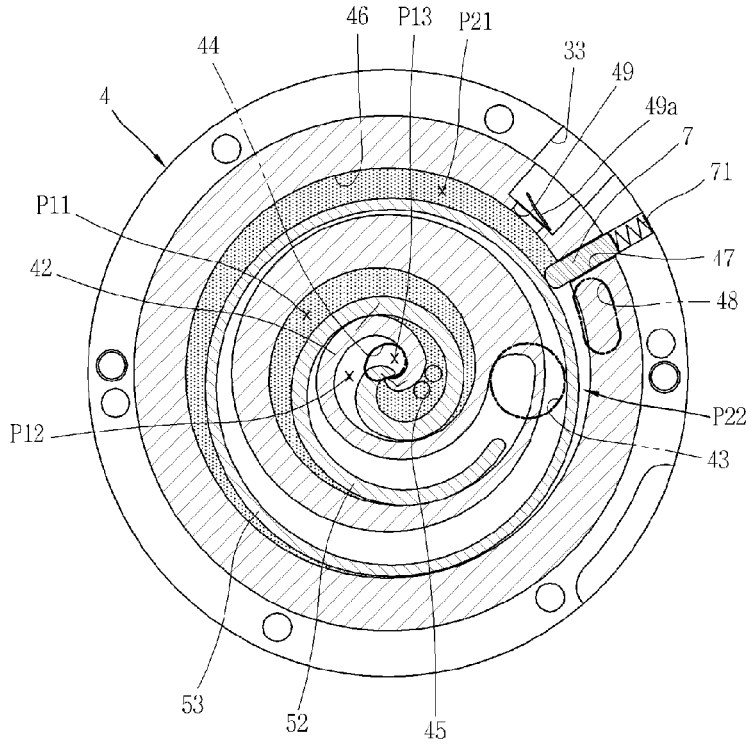
[Fig. 17]
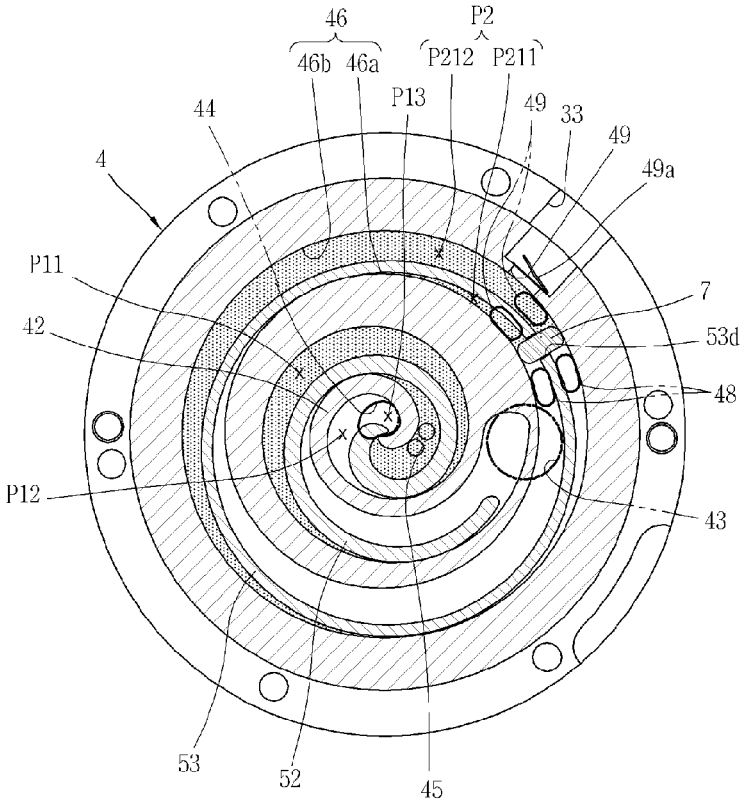

SCROLL COMPRESSOR

CROSS-REFERENCE TO RELATED PATENT APPLICATIONS

This application is a U.S. National Stage application under 35 U.S.C. §371 of PCT Application No PCT/KR2014/004900, filed Jun. 2, 2014, which claims priority to Korean Patent Application Nos. 10-2013-0064757 filed Jun. 5, 2013 and 10-2014-0059890, filed May 19, 2014, whose entire disclosures are hereby incorporated by reference.

TECHNICAL FIELD

The present disclosure relates to a compressor, and more particularly, to a two-stage compressor having a scroll side compression unit and a rotary side compression unit.

BACKGROUND ART

In general, a refrigerant compressor may be applicable to a vapor compression type freezing cycle (hereinafter, abbreviated as a "freezing cycle"), such as a refrigerator, an air conditioner or the like. For a refrigerant compressor, there has been introduced a constant speed compressor driven at a predetermined speed or an inverter type compressor in which its rotation speed is controlled.

A refrigerant compressor can be typically classified into a hermetic type compressor in which a drive motor which is an electric motor and a compression unit operated by the drive motor are provided together in an inner space of the sealed casing, and an open type compressor in which the drive motor is separately provided at an outside of the casing. The hermetic compressors are mostly used for household or commercial freezing equipment.

Furthermore, a refrigerant compressor can be classified into a reciprocating type, a scroll type, a rotary type, and the like according to its refrigerant compression method. The rotary compressor uses a method of compressing refrigerant using a rolling piston performing an eccentric rotational movement in a compression space of the cylinder and a vane brought into contact with the rolling piston to partition the compression space of the cylinder into a suction chamber and a discharge chamber.

In recent years, there has been known a compound rotary compressor having a plurality of cylinders in which a rolling piston and a vane are independently provided for the plurality of cylinders to compress refrigerant using one drive motor. The compound rotary compressor can be also classified into a variable capacity type rotary compressor in which a plurality of cylinders are independent from one another to independently compress refrigerant and a two-stage rotary compressor in which a plurality of cylinders are communicated with one another to sequentially compress refrigerant.

On the other hand, scroll compressor is a compressor in which a fixed scroll is fixed to an inner space of container, and an orbiting scroll is engaged with the fixed scroll to perform an orbiting movement, and two pairs of compression chambers consisting of a suction chamber, an intermediate pressure chamber and a discharge chamber are continuously formed between a fixed wrap of the fixed scroll and an orbiting wrap of the orbiting scroll.

The scroll compressor may perform inhalation, compression and discharge cycles in a smoothly sequential manner while obtaining a relatively high compression ratio compared to other types of compressors to obtain a stable torque, and thus widely used for refrigerant compression in air conditioning units, and the like. However, the scroll compressor should be formed such that the fixed wrap is engaged with the orbiting wrap, and thus is difficult in fabrication compared to other compressors, and as a result, the compound or two-stage scroll compressors have not been widely developed.

DISCLOSURE OF INVENTION

Technical Problem

However, the above-mentioned rotary compressor in the related art uses a method of compressing refrigerant while an eccentric portion thereof performs an orbiting movement, and thus the vibration noise of the compressor is aggravated, and moreover, in case of a two-stage rotary compressor, an intermediate pressure becomes unstable while generating a pulsating pressure between a one-stage compression unit and a two-stage compression unit, thereby reducing the compression efficiency.

On the contrary, in case of a scroll type compressor, a volume ratio may be determined due to the characteristic of a scroll compressor and thus a fabrication cost is excessively consumed compared to performance though causing the loss of lack of compression in a high pressure ratio condition during the design of a low volume ratio, and there is a limit in fabricating a high efficiency compressor such as a two-stage scroll compressor.

In addition, the loss of compression efficiency due to a dead volume may occur in both the rotary type compressor and scroll type compressor, and moreover, in case of the scroll type compressor, the orbiting scroll may be supported by a rotation prevention member to destabilize the behavior, and a boss portion at which the orbiting scroll and crankshaft are coupled to each other may be protruded, thereby causing a problem of increasing oil stirring.

Solution to Problem

An aspect of the present disclosure is to provide a compressor for maintaining a low vibration noise with a low fabrication cost.

Furthermore, another aspect of the present disclosure is to provide a compressor that is applicable to a two-stage compressor due to advantageous balancing maintenance, stable intermediate pressure, ease of fabrication, and ease of controlling discharge pressure according to the operating condition.

In addition, still another aspect of the present disclosure is to provide a compressor capable of reducing a dead volume, stabilizing the behavior of the compressor, increasing a suction volume, and minimizing loss due to oil stirring.

In order to accomplish the foregoing object, there is provided a compressor, including a container; a drive motor provided in the container; a crankshaft coupled to a rotor of the drive motor; a first scroll coupled to the crankshaft to receive a rotational force of the drive motor to perform an orbiting movement; a second scroll coupled to the first scroll to form a first compression unit and a second compression unit along with the first scroll; and a vane provided in the first scroll or second scroll to be brought into contact with the other side scroll to form the second compression unit, wherein the first compression unit is carried out in a scroll compression mode and the second compression unit is carried out in a rotary compression mode.

Here, the first scroll may include a first plate portion; a first wrap portion formed to be protruded at a predetermined height at one side of the first plate portion to constitute the first compression unit; and a piston portion formed at the first plate portion to constitute the second compression unit along with the vane.

Furthermore, the piston portion may be formed at a different height from that of the first wrap portion.

Furthermore, at least part of the piston portion may be formed to be overlapped with the first wrap portion on the same plane.

Furthermore, the piston portion may further include a bearing portion extended from the piston portion in an outer circumferential surface direction to constitute a bearing surface along with the second scroll.

Furthermore, a shaft coupling portion into which the crankshaft is inserted may be formed on the first plate portion, and the shaft coupling portion may have a height at least part of which is overlapped with the second compression unit in an axial direction.

Furthermore, an eccentric portion inserted into the shaft coupling portion may be eccentrically formed on the crankshaft with respect to the rotational center of the crankshaft.

Furthermore, a boss portion protruded from an opposite surface of the first wrap portion and coupled to the crankshaft may be formed on the first plate portion.

Furthermore, a boss coupling groove into which the boss portion is inserted may be formed on the crankshaft, and the boss coupling groove may be eccentrically formed with respect to the rotational center of the crankshaft.

Furthermore, a bush bearing may be provided on an outer circumferential surface of the boss portion or an inner circumferential surface of the boss coupling groove, and the bush bearing may be made of a plastic material having an ether ketone linkage.

Furthermore, the bush bearing may be formed in an annular cross-sectional shape.

Here, the second scroll may include a second plate portion; and a second wrap portion formed on the second plate portion to constitute a first compression unit, wherein a compression space portion constituting the second compression unit is formed on the second plate portion.

Furthermore, the compression space portion may be formed at a different height from that of the second wrap portion.

Furthermore, the second scroll may be formed with a first inlet port and a first outlet port communicated with the first compression unit, and a second inlet port and a second outlet port communicated with the second compression unit, respectively.

Furthermore, the first inlet port may be directly connected to a suction pipe passing through the container, and the second outlet port may be communicated with an internal space of the container.

Furthermore, a middle cover having a predetermined internal space may be coupled to the second scroll to communicate the first outlet port with the second inlet port.

Furthermore, a suction pipe passing through the container may be directly connected to the first inlet port, and the first outlet port and second inlet port may be communicated with an internal space of the container, and a discharge pipe passing through the container may be directly connected to the second outlet port.

Furthermore, the first inlet port may be communicated with an internal space of the container, and the second outlet port may be directly connected to a discharge pipe passing through the container.

Furthermore, a middle cover having a predetermined internal space may be coupled to the second scroll to communicate the first outlet port with the second inlet port.

Here, at least one of a vane side contact surface and a piston side contact surface brought into contact with the vane and piston portion may be formed in a planar shape.

Furthermore, both the vane side contact surface and piston side contact surface may be formed in a planar shape, and the width (Wp) of the piston side contact surface may satisfy the following equation:

$$2\epsilon - W_V < WP \leq 2\epsilon + W_V,$$

wherein an orbiting radius of the first scroll is, and a width of the vane side contact surface brought into contact with the piston portion is Wv.

In addition, in order to accomplish an aspect of the present disclosure, there is provided a compressor, wherein a scroll side compression unit and a rotary side compression unit are formed between a first scroll and a second scroll engaged with each other, and the scroll side compression unit and rotary side compression unit are sequentially connected to each other.

Here, the scroll side compression unit and rotary side compression unit may be located on different planes.

Furthermore, at least part of the scroll side compression unit and rotary side compression unit may be located on the same plane.

Furthermore, the first scroll may be eccentrically coupled to an eccentric portion of the crankshaft, and at least part of the eccentric portion and the rotary side compression unit may be located on the same plane.

Furthermore, the first scroll may be eccentrically coupled to an eccentric portion of the crankshaft, and the eccentric portion and the rotary side compression unit may be located on different planes.

Advantageous Effects of Invention

According to a two-stage compressor in accordance with the present disclosure, a one-stage compression unit at a low pressure side may be formed in a scroll mode to constantly maintain a discharge volume, thereby facilitating the design of a stroke volume of a two-stage compression unit at a high pressure side.

Furthermore, the first-stage compression unit may be formed in a scroll mode, thereby uniformly maintaining an intermediate pressure while lengthening the intermediate pressure section as well as reducing the intermediate pressure, if necessary, and facilitating oil injection.

Furthermore, the first-stage compression unit may be formed in a scroll mode to allow part of refrigerant compressed during a low pressure ratio operation to be easily bypassed, thereby allowing the compressor to properly cope with a freezing cycle operating condition.

Furthermore, the two-stage compression unit may be formed in a rotary mode to use an outer circumferential surface of the orbiting wrap of the orbiting scroll or form it in a different mode from that of the one-stage compression unit, thereby facilitating the fabrication of the two-stage compression unit.

Furthermore, the two-stage compression unit may be formed in a rotary mode to freely control a discharge volume, thereby controlling a discharge pressure as well as minimizing a lack of compression through discharge delay in a high pressure ratio operating condition.

Furthermore, the two-stage compression unit may be formed in a rotary mode to seal the two-stage compression unit using a rear pressure of the one-stage compression unit in a scroll mode, thereby minimizing the leakage of the two-stage compression unit in an axial direction.

Furthermore, the rotary compression unit which is a two-stage compression unit may be located lower than the scroll compression unit which is a one-stage compression unit, and thus the two-stage compression unit may be formed on an outer circumferential surface of the plate portion of the orbiting scroll to minimize a dead volume in the two-stage compression unit, thereby enhancing the compressor efficiency.

Furthermore, since the two-stage compression unit is formed on an outer circumferential surface of the plate portion of the orbiting scroll, an eccentric portion of the crankshaft may be inserted and coupled to an inner side of the plate portion of the orbiting scroll, and accordingly, a tangential gas force in the two-stage compression unit may be overlapped with a bearing height between the crankshaft and the orbiting scroll. Through this, the behavior of the orbiting scroll may be stabilized to reduce leakage in an axial direction, thereby enhancing the compressor efficiency. Moreover, since the length of a boss portion protruded to a bottom surface of the plate portion to be coupled to the crankshaft is reduced, input loss due to oil stirring may be decreased, thereby enhancing the compressor efficiency.

Furthermore, since the two-stage compression unit is formed on an outer circumferential surface of the plate portion of the orbiting scroll, a free space may be increased on an upper surface of the plate portion of the orbiting scroll to the same extent to extend a wrap end angle, thereby increasing the volume ratio due to an increased suction space of the one-stage compression unit.

BRIEF DESCRIPTION OF DRAWINGS

FIG. 1 is a longitudinal cross-sectional view illustrating an example of a two-stage compressor according to the present disclosure.

FIG. 2 is an enlarged longitudinal cross-sectional view illustrating a compression unit in a two-stage compressor according to FIG. 1.

FIG. 3 is a cross-sectional view along line "I-I" in FIG. 2.

FIG. 4 is a perspective view in which a stationary scroll and an orbiting scroll are separated from a compression unit according to FIG. 2.

FIG. 5 is a longitudinal cross-sectional view for explaining a refrigerant suction and discharge path in a two-stage compressor according to FIG. 1.

FIGS. 6 through 8 are longitudinal and transverse cross-sectional views illustrating a suction and discharge path in a two-stage compressor according to FIG. 1.

FIG. 9 is a longitudinal cross-sectional view illustrating another embodiment of a two-stage compressor according to the present disclosure.

FIG. 10 is a cross-sectional view along line "II-II" in FIG. 9.

FIG. 11 is a perspective view illustrating an example in which a contact surface between the piston portion and the vane is formed in a planar shape in a compressor according to the present disclosure.

FIG. 12 is a schematic view for explaining a contact relation between the piston portion and the vane with respect to a rotational angle of the crankshaft in a compressor according to FIG. 11.

FIGS. 13 and 14 are transverse cross-sectional views a contact surface between the piston portion and the vane in a compressor according to FIG. 11.

FIG. 15 is an enlarged longitudinal cross-sectional view illustrating a compression unit associated with another embodiment in a two-stage compressor according to FIG. 1.

FIG. 16 is a cross-sectional view along line "III-III" in FIG. 15.

FIG. 17 is a transverse cross-sectional view illustrating another embodiment of a compression unit in a two-stage compressor according to FIG. 15.

BEST MODE FOR CARRYING OUT THE INVENTION

Hereinafter, a compressor according to the present disclosure will be described in detail with reference to an embodiment illustrated in the accompanying drawings.

FIG. 1 is a longitudinal cross-sectional view illustrating an example of a two-stage compressor according to the present disclosure, and FIG. 2 is an enlarged longitudinal cross-sectional view illustrating a compression unit in a two-stage compressor according to FIG. 1, and FIG. 3 is a cross-sectional view along line "I-I" in FIG. 2, and FIG. 4 is a perspective view in which a stationary scroll and an orbiting scroll are separated from a compression unit according to FIG. 2, and FIG. 5 is a longitudinal cross-sectional view for explaining a refrigerant suction and discharge path in a two-stage compressor according to FIG. 1.

As described above, in a two-stage compressor according to the present disclosure, a drive motor 2 for generating a rotational force in an internal space 11 of the container 1 may be provided therein, and a main frame 3 may be fixed and provided at an upper side of the drive motor 2.

A stationary scroll 4 may be fixed and provided on an upper surface of the main frame 3, and an orbiting scroll 5 may be provided between the main frame 3 and stationary scroll 4 in an orbiting manner. The orbiting scroll 5 may be eccentrically coupled to a crankshaft 23 coupled to a rotor of the drive motor 2 to form a scroll side compression unit (P1) and a rotary side compression unit (P2). The rotary side compression unit (P2) may form one compression chamber consisting of a suction chamber and a discharge chamber, whereas the scroll side compression unit (P1) forms two pairs of compression chambers consisting of a suction chamber (P11), an intermediate pressure chamber (P12), and a discharge chamber (P13).

Furthermore, an oldham ring 6 for preventing the rotational movement of the orbiting scroll 5 may be provided between the stationary scroll 4 and orbiting scroll 5.

The stationary scroll 4 may be protruded from a bottom surface of the plate portion 41 to form a stationary wrap 42 to constitute the scroll side compression unit (P1) along with an orbiting wrap 52 of the orbiting scroll 5 which will be described later.

The stationary wrap 42 may be formed in an involute shape, and may be also formed in a logarithmic spiral shape or in various other shapes.

A first inlet port 43 for guiding refrigerant to the scroll side suction chamber (P11) constituting an outermost compression chamber of the scroll side compression unit may be formed at one side of the plate portion 41 of the stationary scroll 4. The first inlet port 43 may be formed to communicate with only a scroll side suction chamber.

A first outlet port 44 for discharging one-stage-compressed refrigerant from the scroll side compression unit (P1) to an internal space of the middle cover 8 which will be described later may be formed at a central portion of the plate portion 41 of the stationary scroll 4 to communicate with the scroll side discharge chamber (P13).

Furthermore, a bypass hole 45 for bypassing part of refrigerant compressed in the intermediate pressure chamber of the scroll side compression unit (P1) during a low volume ratio operation may be formed around the first outlet port 44. A bypass valve (not shown) for selectively switching the bypass hole 45 may be provided at an output end of the bypass hole.

Furthermore, an oil supply hole (not shown) for injecting oil into the scroll side intermediate pressure chamber (P12) may be formed around the first outlet port 44.

A compression chamber space portion 46 having a predetermined depth and width to constitute the rotary side compression unit (P2) while a piston portion 53 of the orbiting scroll 5 which will be described later performs an orbiting movement may be formed at an outside of the stationary wrap 42. The compression chamber space portion 46 may be formed in a stepped manner with respect to a first bearing surface (B1) formed at an outside of the stationary wrap 42.

The compression chamber space portion 46 may be formed in a circular shape to allow the piston portion 53 to perform an orbiting movement. Furthermore, the depth (H2) of the compression chamber space portion 46 may be preferably formed to be lower than the depth (H1) of the scroll side compression unit (P1) since the rotary side compression unit (P2) constitutes a secondary compression chamber.

A vane 7 for dividing the rotary side compression unit (P2) into a suction chamber (P21) and a discharge chamber (P22) may be coupled to the stationary scroll 4. A vane slot 47 may be formed on the stationary scroll 4 such that the vane 7 is inserted into one side of the compression chamber space portion 46 to be slid in a radial direction. A second inlet port 48 may be formed at one side of the vane slot 47 in a circumferential direction to guide refrigerant one-stage-compressed in the scroll side compression unit (P1) to the rotary side compression unit (P2), and a second outlet port 49 for discharging refrigerant two-stage-compressed in the rotary side compression unit (P2) may be formed at the other side of the vane slot 47 in a circumferential direction. A discharge vale 49*a* may be provided at an output end of the second outlet port 49 to control a discharge pressure of refrigerant discharged from the rotary side compression unit (P2). Though not shown in the drawing, the vane slot may be formed on an orbiting scroll. In this case, an outer end of the vane may be brought into contact with an inner circumferential surface of the compression space portion of the stationary scroll.

Furthermore, the first outlet port 44 and second outlet port 49 may be connected to each other through a pipe or duct, but may be connected to the middle cover 8 having an internal space larger than the cross-sectional area of the first outlet port 44 as illustrated in FIG. 2.

The middle cover 8 may be formed in a cap shape to substantially surround a rear surface of the stationary scroll 4 and fastened to the stationary scroll 4 with a bolt. A pressure difference may occur between an internal space 81 of the middle cover 8 and an internal space 11 of the container 1 since the internal space 11 of the container 1 is filled with two-stage-compressed refrigerant whereas the internal space 81 of the middle cover 8 is filled with one-stage-compressed refrigerant. Accordingly, a sealing member 82 may be preferably provided between an open end of the middle cover 8 and a rear surface of the stationary scroll 4.

In addition, a through hole 83 may be formed on the middle cover 8. A first connecting pipe 84 may be inserted into the through hole 83 and fixed and coupled thereto. An upper end of the first connecting pipe 84 may be sealed and coupled to a second connecting pipe 12 connected to a refrigerant pipe through the container 1 whereas a lower end of the first connecting pipe 84 is inserted into the first inlet port 43 and sealed and coupled thereto.

A flange portion may be provided in the first connecting pipe 84. The second connecting pipe 12 may be sealed and coupled to the container 1 whereas the flange portion 84*a* of the first connecting pipe 84 is closely coupled to an upper surface of the middle cover 8. Furthermore, A sealing member (not shown) may be preferably provided between the flange portion 84*a* of the first connecting pipe 84 and the middle cover 8 closely adhered thereto, at a portion in contact with the first connecting pipe 84 and second connecting pipe 12, and the like.

On the other hand, the orbiting wrap 52 may be formed on the orbiting scroll 5 to be protruded from an upper surface of the plate portion 51 and engaged with the stationary wrap 42 so as to constitute two pairs of scroll side compression units (P1), and a piston portion 53 may be formed at an outside of the orbiting wrap 52 to form the rotary side compression unit (P2) while performing an orbiting movement in the compression chamber space portion 46.

The piston portion 53 may be formed in a ring shape on an upper surface of the plate portion 51, but in this case, a vacant space may be formed at an inside of the piston portion 53 and refrigerant coming out of the rotary side compression unit (P2) may be filled therein during the compression, and thus becomes a type of dead volume. Accordingly, the piston portion 53 may be preferably formed on an outer circumferential surface of the plate portion 51, namely, a portion that is not overlapped with the orbiting wrap 52, thereby removing a dead volume due to the piston portion 53.

The piston portion 53 of the orbiting scroll 5 may be formed downward in a stepped manner by a predetermined height from an upper surface of the plate portion 51 of the orbiting scroll 5, and a bearing portion 54 may be extended and formed at a lower end of the piston portion 53 to constitute a bearing surface (B2) along with a bottom surface of the plate portion 41 of the stationary scroll 4. Accordingly, the rotary side compression unit (P2) may include an inner circumferential surface constituting the compression chamber space portion 46 of the stationary scroll 4, an outer circumferential surface constituting the piston portion 53 of the orbiting scroll 5 to the bottom surface, and an upper surface of the bearing portion 54.

Furthermore, the piston portion 53 of the orbiting scroll 5 may be formed in a cylindrical shape, and the piston portion 53 may be eccentrically formed with respect to the rotational center of the orbiting scroll 5. The height (H2) of the piston portion 53 may be formed to be higher than the height (H1) of the orbiting wrap 52 constituting the scroll side compression unit (P1), but a volume of the one-stage compression unit may be typically formed to be larger than that of the two-stage compression unit, and thus the height (H2) of the piston portion constituting the two-stage compression unit may be preferably formed to be lower than the height (H1) of the orbiting wrap constituting the one-stage compression unit.

A boss portion 55 may be formed at a bottom surface of the plate portion 51 of the orbiting scroll 5 to receive a rotational force by inserting an eccentric portion 23*a* of the crankshaft 23 thereinto.

On the contrary, when a shaft coupling groove 56 is formed at a bottom surface of the plate portion 51 of the orbiting scroll 5 to insert the eccentric portion 23*a* of the crankshaft 23 thereinto as illustrated in FIG. 2, the height (H3) of the shaft coupling groove 56 may be overlapped with the height (H2) of the piston portion 53 by a predetermined length (L) in an axial direction. In this case, the bearing height of the eccentric portion 23*a* at which the crankshaft 23 is coupled to the orbiting scroll 5 may be similar to the height of a tangential gas force of the piston portion 53 to stabilize the behavior of the orbiting scroll 5. Furthermore, in this case, oil stiffing generated due to the boss portion 55 may be reduced while the height of the boss portion 55 is reduced in inverse proportion to the depth of the shaft coupling groove 56, thereby enhancing compressor efficiency to input. Furthermore, in this case, a free space may be created on an upper surface of the orbiting scroll 5 to extend a wrap end angle, and thus a volume of the suction chamber may be increased, thereby enhancing the volume ratio. Furthermore, in this case, the length of the boss portion 55 may be reduced to lower the height of the compression unit, thereby allowing the miniaturization of the compressor.

On the drawing, non-described reference numerals 13, 31, 32, 33, 71 and B2 denote a discharge pipe, a shaft receiving hole, a bush pocket, a communication hole, a vane spring, and a second bearing surface, respectively.

The foregoing two-stage compressor according to the present embodiment has the following operational effect.

In other words, when power is applied to the drive motor 2 to generate a rotational force, the orbiting scroll 5 eccentrically coupled to the crankshaft 23 of the drive motor 2 is continuously moved between the orbiting wrap 52 and stationary wrap 42 while performing an orbiting movement to form the scroll side compression unit (P1) having two pairs of compression chambers consisting of a suction chamber (P11), an intermediate pressure chamber (P12), and a discharge chamber (P13). The compression chamber of the scroll side compression unit (P1) is continuously formed with several steps while gradually reducing the volume thereof in the central direction.

Then, as illustrated in FIG. 5, refrigerant supplied from an outside of the container 1 through the second connecting pipe 12 sequentially passes through the first connecting pipe 84 and first inlet port 43 and directly flows into the scroll side compression unit (P1), and the refrigerant is one-stage-compressed while being moved in the discharge chamber direction of the scroll side compression unit (P1) by an orbiting movement of the orbiting scroll 5 and then discharged to the internal space 81 of the middle cover 8 through the first outlet port 44 of the stationary scroll 4 in the discharge chamber (P13) of the scroll side compression unit.

Then, the one-stage-compressed refrigerant discharged to the internal space 81 of the middle cover 8 is inhaled into the suction chamber (P21) of the rotary side compression unit (P2) through the second inlet port 48 of the stationary scroll 4 to repeat a series of processes of being discharged to the internal space 11 of the container 1 through the second outlet port 49 while being two-stage-compressed by the piston portion 53 and vane 7.

Here, the piston portion 53 is formed on an outer circumferential surface of the orbiting scroll 5 to form a compression chamber of the rotary side compression unit (P2) along with the vane 7 while performing an orbiting movement in the compression chamber space portion 46 of the stationary scroll 4 along the orbiting movement of the orbiting scroll 5.

As a result, a one-stage compression unit at a low pressure side may be formed in a scroll mode to constantly maintain a discharge volume, thereby facilitating the design of a stroke volume of a two-stage compression unit at a high pressure side.

Furthermore, the first-stage compression unit may be formed in a scroll mode having a long trajectory of the compression chamber, thereby uniformly maintaining an intermediate pressure while lengthening the intermediate pressure section as well as reducing the intermediate pressure, if necessary, and facilitating oil injection.

Furthermore, the first-stage compression unit may be formed in a scroll mode to allow part of refrigerant compressed during a low pressure ratio operation to be easily bypassed, thereby allowing the compressor to properly cope with a freezing cycle operating condition.

Furthermore, the two-stage compression unit at a high pressure side may be formed in a rotary mode to use an outer circumferential surface of the orbiting wrap of the orbiting scroll or form it in a different mode from that of the one-stage compression unit, thereby facilitating the fabrication of the two-stage compression unit.

Furthermore, the two-stage compression unit may be formed in a rotary mode to freely control a discharge volume, thereby controlling a discharge pressure as well as minimizing a lack of compression through discharge delay in a high pressure ratio operating condition.

Furthermore, the two-stage compression unit may be formed in a rotary mode to seal the two-stage compression unit using a rear pressure of the one-stage compression unit in a scroll mode, thereby minimizing the leakage of the two-stage compression unit in an axial direction.

Furthermore, the rotary compression unit which is a two-stage compression unit may be located lower than the scroll compression unit which is a one-stage compression unit, and thus the two-stage compression unit may be formed on an outer circumferential surface of the plate portion of the orbiting scroll to minimize a dead volume in the two-stage compression unit, thereby enhancing the compressor efficiency.

Furthermore, since the two-stage compression unit is formed on an outer circumferential surface of the plate portion of the orbiting scroll, an eccentric portion of the crankshaft may be inserted and coupled to an inner side of the plate portion of the orbiting scroll, and accordingly, a tangential gas force in the two-stage compression unit may be overlapped with a bearing height between the crankshaft and the orbiting scroll. Through this, the behavior of the orbiting scroll may be stabilized to reduce leakage in an axial direction, thereby enhancing the compressor efficiency. Moreover, since the length of a boss portion protruded to a bottom surface of the plate portion to be coupled to the crankshaft is reduced, input loss due to oil stirring may be decreased, thereby enhancing the compressor efficiency.

Furthermore, since the two-stage compression unit is formed on an outer circumferential surface of the plate portion of the orbiting scroll, a free space may be increased on an upper surface of the plate portion of the orbiting scroll to the same extent to extend a wrap end angle, thereby increasing the volume ratio due to an increased suction space of the one-stage compression unit.

On the other hand, a two-stage compression unit according to another embodiment of the present disclosure will be described below.

In other words, according to the foregoing embodiment, the first inlet port to the suction pipe, the second outlet port to an inner space of the container, and the first outlet port is directly connected to the second inlet port and thus the internal space of the container may form a high pressure portion, but according to the present embodiment, as illustrated in FIG. 6, it is formed such that the first outlet port 44 and second inlet port 48 are communicated with the internal space 11 of the container 1, respectively, whereas the first inlet port 43 and the second outlet port 49 are directly connected to the second connecting pipe 12 connected to the suction pipe and the discharge pipe 13, respectively.

The fundamental configuration and operational effect of a two-stage compressor according to the present embodiment is substantially the same as the foregoing embodiment. However, according to the present embodiment, since the internal space 11 of the container 1 is filled with refrigerant one-stage-compressed in the scroll side compression unit (P1), the internal space 11 of the container 1 may form an intermediate pressure portion. Accordingly, compared to the foregoing embodiments, the cooling effect of the drive motor may be enhanced, thereby enhancing the compressor efficiency.

On the other hand, a two-stage compression unit according to still another embodiment of the present disclosure will be described below.

In other words, according to the present embodiment, as illustrated in FIG. 7, the first outlet port 44 and second inlet port 48 are communicated with the internal space 81 of the middle cover 8 whereas the first inlet port 43 and the second outlet port 49 are directly connected to the internal space 11 of the container 1 and the discharge pipe 13, respectively.

The fundamental configuration and operational effect of a two-stage compressor according to the present embodiment is substantially the same as the foregoing embodiment. However, according to the present embodiment, since the internal space 11 of the container 1 is filled with refrigerant inhaled through the second connecting pipe 12, the internal space 11 of the container 1 may form a low pressure portion. Accordingly, compared to the foregoing embodiments, the cooling effect of the drive motor may be enhanced, thereby enhancing the compressor efficiency.

On the other hand, a two-stage compression unit according to yet still another embodiment of the present disclosure will be described below.

In other words, according to the present embodiment, the scroll side compression unit and rotary side compression unit are configured with a one-stage compression unit and a two-stage compression unit, respectively, but according to the present embodiment, the rotary side compression unit and scroll side compression unit are configured with a one-stage compression unit and a two-stage compression unit, respectively.

To this end, the first inlet port 481 and first outlet port 491 may be formed at both sides of the vane slot 47 of the stationary scroll 4, and it may be formed such that the second outlet port 441 is communicated with the discharge chamber of the scroll side compression unit (P1) while the second inlet port 431 is communicated with the suction chamber of the scroll side compression unit (P1).

Even in this case, the fundamental configuration and operational effect of a two-stage compressor such as a middle cover or each connecting pipe as well as a drive motor is substantially the same as the foregoing embodiments. However, in this case, a volume of the rotary side compression unit which is a one-stage compression unit should be formed to be larger than that of the scroll side compression unit which is a two-stage compression unit, and thus the volume of the rotary side compression unit may be formed to be increased to the maximum, thereby enhancing the entire compressor capacity.

On the other hand, a coupling structure between the crankshaft and orbiting scroll in a two-stage compressor according to still yet another embodiment of the present disclosure will be described below.

In other words, as illustrated in FIGS. 9 and 10, the orbiting scroll 5 may be inserted and coupled to the crankshaft 23 since the boss portion 55 is formed at a bottom surface of the plate portion 51. In this case, as illustrated in FIG. 10, the boss coupling groove 23*b* into which the boss portion 55 of the orbiting scroll 5 is inserted may be eccentrically formed from the central axis (O) at an upper end of the crankshaft 23.

Even in this case, the piston portion 53 may be formed on an outer circumferential surface of the plate portion 51 of the orbiting scroll 5 not to be overlapped with the orbiting wrap 52. Furthermore, a ring-shaped bush bearing 57 may be pressed or coated on an outer circumferential surface of the boss portion 55 or an inner circumferential surface of the eccentric portion 23*a* of the crankshaft 23 inserted into the boss portion 55. The bush bearing 57 may be made of a plastic material having an ether ketone linkage. An elongation rate may be preferably designed by taking a thermal expansion coefficient or the like of the orbiting scroll 5 into consideration to have a suitable restoring force while pressing the bush bearing 57, thereby preventing the removal of the bush bearing 57.

The fundamental operational effect of the present embodiment as described above is substantially the same as the foregoing embodiment, namely, an embodiment in which the piston portion is formed on an outer circumferential surface of the plate portion of the orbiting scroll. However, according to the present embodiment, as illustrated in FIG. 5, the height of the compression unit may be further decreased when the boss portion 55 is formed on the orbiting scroll 5, and the boss coupling groove 23*b* into which the boss portion 55 of the orbiting scroll 5 is inserted is formed on the crankshaft 23, thereby further enhancing the miniaturization of the compressor. Furthermore, in this case, the boss portion 55 of the orbiting scroll 5 may be inserted and coupled to the boss coupling groove 23*b* of the crankshaft 23 and thus an outer circumferential surface of the bush bearing 57 may be brought into contact with an inner circumferential surface of the boss coupling groove 23*b* on the whole, thereby reducing the abrasion of the bush bearing 57. Furthermore, in this case, the friction loss of the bush bearing 57 may be reduced to enhance compression efficiency and reliability, and reduce noise, and decrease material cost. In addition, in this case, the bush bearing 57 may be formed in a ring shape, and thus the removal of the bush bearing 57 from the boss portion 55 may be effectively suppressed as a material forming the bush bearing 57 is made of a plastic material having an ether ketone linkage though being pressed to the boss portion 55 by taking thermal expansion coefficient, elongation rate, press-fit allowance, or the like, thereby enhancing the reliability of the compressor.

On the other hand, a contact surface between the piston portion and the vane in a compressor according to another embodiment of the present disclosure will be described below.

In other words, according to the foregoing embodiment, the piston portion may be formed in a cylindrical shape, and the contact surface of the vane is formed in a curved surface shape, but in this case, the contact surface of the piston portion (hereinafter, referred to as a "piston side contact surface") is brought into line contact with the contact surface of the vane (hereinafter, referred to as a "vane side contact surface"), and thus a sealing area between the piston side contact surface and the vane side contact surface is not so large. Accordingly, there has been a concern that high pressure refrigerant in the discharge chamber can be leaked into the suction chamber through a contact surface between the piston side contact surface and the vane side contact surface by a pressure difference between the discharge chamber and suction chamber of the rotary side compression unit.

Furthermore, abrasion may occur on the piston side contact surface or vane side contact surface as the piston side contact surface is brought into line contact with the vane side contact surface, thereby aggravating the leakage of refrigerant. In particular, the vane may be slightly inclined due to a side force, and as a result, there has been a concern that the behavior of the vane causes jumping or the vane is locally worn out.

Taking this into consideration, according to the present embodiment, the piston side contact surface and vane side contact surface may be formed in a planar surface to enhance a sealing effect between the piston portion and the vane, and suppress abrasion therebetween, and stabilize the behavior of the vane.

As illustrated in FIGS. 11 and 12, both the vane side contact surface 53*a* and piston side contact surface 7*a* may be formed in a planar shape. In this case, the width ($W_P$) of the piston side contact surface 53*a* may be preferably formed to have a range of $2\epsilon-W_V<WP\leq 2\epsilon+W_V$. Here, $\epsilon$ is an orbiting radius of the first scroll, and $W_V$ is a width of the vane.

Accordingly, if the planar portion width ($W_P$) of the piston side contact surface 53*a* satisfies the relation of $W_P=2\epsilon+W_V$, then an edge 53*c* at which the piston side contact surface 53*a* meets the contact surface 53*b* which is a curved surface brought into contact with the piston side contact surface 53*a* may meet an outer edge (brought into contact with the discharge chamber or suction chamber) 7*b* of the vane 7 when the piston portion 53 is rotated around the vane 7 by 90 or 270 degrees. Accordingly, as a contact area between the vane side contact surface 7*a* and the piston side contact surface 53*a* becomes the maximum, the sealing effect may be enhanced and the load may be distributed, thereby suppressing abrasion.

On the contrary, if the planar portion width ($W_P$) of the piston side contact surface 53*a* satisfies the relation of $W_P=2\epsilon-W_V$, then an edge 53*c* at which the piston side contact surface 53*a* which is a planar portion meets the contact surface 53*b* which is a curved surface may meet an inner edge 7*b*. As a result, the planar portion width of the piston side contact surface 53*a* becomes minimum to minimize a dead volume generated due to the piston side contact surface 53*a*. However, this case or an outer edge of the vane 7 or an inner edge thereof may be preferably chamfered with a curved or inclined surface to reduce abrasion. Here, symbols t, C1, and C2 denote a thickness of the vane, the center of the compression chamber space portion, and the center of the piston portion, respectively.

On the other hand, as illustrated in FIG. 13, the piston side contact surface 53*a* may be formed in a planar surface, and the vane side contact surface 7*a* may be formed in a curved surface. In this case, the planar portion width ($W_P$) of the piston side contact surface 53*a* may be preferably formed to have a range of $W_P=2\epsilon$ Here, symbols $\epsilon$, t, C1, and C2 denote a circular radius of the piston portion, a thickness of the vane, the center of the compression chamber space portion, and the center of the piston portion, respectively.

Even in the above-mentioned case, compared to the piston portion 53 formed in a cylindrical shape, it may be possible to enhance the linearity of the vane 7 as well as prevent an unstable operation of the vane 7 such as jumping in advance. Through this, it may be possible to enhance a sealing effect between the piston side contact surface 53*a* and the vane side contact surface 7*a*, and reduce the abrasion of the piston side contact surface or vane side contact surface. Furthermore, as the vane side contact surface 7*a* is formed in a curved manner, oil (O) may be collected between the vane side contact surface 7*a* and the piston side contact surface 53*a*, thereby facilitating the formation of an oil film.

On the contrary, if the planar portion width ($W_P$) of the piston side contact surface 53*a* satisfies the relation of $W_P=2\epsilon<W_P$, then a dead volume due to the shape of the piston portion may be increased, and if the planar portion width ($W_P$) of the piston side contact surface 53*a* satisfies the relation of $W_P=W_P<2\epsilon$ then the vane side contact surface which is a curved surface may meet the compression surface (or a curved surface portion of the piston side contact surface) 53*b* which is a curved surface when the piston portion is rotated around the vane by 90 or 270 degrees, thereby aggravating the sealing effect and abrasion suppression effect. In particular, an edge of the piston may be brought into contact with a curved surface of the vane side contact surface to cause abrasion.

On the other hand, as illustrated in FIG. 14, the piston side contact surface 53*a* may be formed in a curved surface, and the vane side contact surface 7*a* in a planar surface. In this case, the width ($W_V$) of the vane side contact surface 7*a* may be preferably formed to have a range of $W_V<2\epsilon$. Here, symbols $\epsilon$, t, C1, and C2 denote a circular radius of the piston portion, a thickness of the vane, the center of the compression chamber space portion, and the center of the piston portion, respectively.

Even in the above-mentioned case, compared to the vane side contact surface 7*a* formed in a curved surface, the linearity of the vane 7 may be enhanced to enhance a sealing effect between the piston side contact surface 53*a* the vane side contact surface 7*a*. Furthermore, when an edge of the vane side contact surface 7*a* is chamfered, it may be possible to reduce the abrasion of the piston side contact surface 53*a* or vane side contact surface 7*a*. Moreover, as the piston side contact surface 53*a* is formed in a cylindrical shape, oil (O) may be collected between the piston side contact surface 53*a* and the vane side contact surface 7*a*, thereby facilitating the formation of an oil film. However, in this case, when the width ($W_V$) of the vane side contact surface 7*a* is formed to satisfy the relation of $2=W_P$, the thickness of the vane may be increased, thereby increasing the dead volume to the same extent.

On the other hand, a rotary side compression unit in a compressor according to another embodiment of the present disclosure will be described below.

In other words, according to the foregoing embodiments, the rotary side compression unit has been formed to be located on a different plane from that of the scroll side compression unit, but according to the present embodiment, at least part of the rotary side compression unit may be formed to be located on the same plane as that of the scroll side compression unit.

FIG. 15 is an enlarged longitudinal cross-sectional view illustrating a compression unit associated with another embodiment in a two-stage compressor according to FIG. 1, and FIG. 16 is a cross-sectional view along line "I-I" in FIG. 15.

As illustrated in the drawings, the orbiting wrap 52 may be formed such that the orbiting scroll 5 is protruded from an upper surface of the plate portion 51 and engaged with the stationary wrap 42 of the stationary scroll 4 to constitute two pairs of scroll side compression units (P1), and the piston portion 53 may be formed at an outside of the orbiting wrap 52 to form the rotary side compression unit (P2) while performing an orbiting movement in the compression chamber space portion 46 provided in the stationary scroll 40.

The piston portion 53 may be formed in a ring shape to be separated from an outer circumferential surface of the orbiting wrap 52 by a predetermined distance to have an inner space and an outer space thereof. Furthermore, the height of the piston portion 53 may be formed to be lower than that of the orbiting wrap 52 to correspond to the depth of the compression chamber space portion 46. Furthermore, the boss portion 55 may be formed on a bottom surface of the plate portion 51 of the orbiting scroll 5 such that a pin portion 23*a* of the crankshaft 23 is inserted thereto to receive a rotational force. The boss portion may be formed in a similar manner to that of the foregoing embodiment.

Even when the piston portion 53 is formed on an upper surface of the plate portion 51 of the orbiting scroll 5, the operational effect thereof is substantially the same as the foregoing embodiment. However, a distance between the bearing height of the eccentric portion 23*a* at which the crankshaft 23 is coupled to the orbiting scroll 5 and the height of a tangential gas force of the piston portion 53 may be increased to destabilize the behavior of the orbiting scroll 5. However, as the rotary side compression unit (P2) is located on the same plane as that of the scroll side compression unit (P1) to a certain extent, part of the gas force generated from the scroll side compression unit (P1) may be cancelled out in the rotary side compression unit (P2), thereby suppressing the behavior of the orbiting scroll by a gas force generated from the scroll side compression unit (P1) and rotary side compression unit (P2), respectively, from being destabilized.

Furthermore, when the piston portion constituting the rotary side compression unit is formed in a ring shape having an inner space and an outer space, both spaces may be all used as a compression space to reduce the compressor capacity. For example, as illustrated in FIG. 17, the vane 7 may be formed such that an inner end thereof is brought into contact with an inner surface 46*a* of the compression chamber space portion 46, and an outer end with an outer surface 46*b* of the compression chamber space portion 46, respectively, and thus the rotary side compression unit (P2) may be formed into an inner rotary side compression unit (P211) and an outer rotary side compression unit (P212), respectively, around the piston portion 53.

In this case, a plurality of the second inlet ports 48 and second outlet ports 49 may be formed to communicate with the inner rotary side compression unit (P211) and outer rotary side compression unit (P212), respectively. Furthermore, even in this case, the first outlet port 44 and second outlet port 49 may be communicated with each other though the middle cover 8, and the first inlet port 43 and the second outlet port 49 may be formed to communicate with the suction pipe and the internal space 11 of the container 1, respectively.

The fundamental configuration and operational effect of a two-stage compressor according to the present embodiment is substantially the same as the foregoing embodiment. However, according to the present embodiment, the compression chambers (P21, P22) may be formed at both sides around the piston portion, respectively, to increase the compressor capacity as well as the gas reaction force of both the compression chambers (P21, P22) may be cancelled out to further stabilize the behavior of the orbiting scroll 5.

The invention claimed is:

1. A compressor, comprising:

a drive motor provided in the container;

a crankshaft coupled to a rotor of the drive motor;

a first scroll coupled to the crankshaft to receive a rotational force of the drive motor to perform an orbiting movement;

a second scroll coupled to the first scroll to form a first compression unit and a second compression unit along with the first scroll; and a vane provided in the first scroll or second scroll to be brought into contact with the other side scroll to form the second compression unit, wherein the first compression unit is carried out in a scroll compression mode and the second compression unit is carried out in a rotary compression mode, and wherein the second scroll comprises:

a second plate portion;

a second wrap portion formed on the second plate portion to constitute a first compression unit; and a compression space portion constituting the second compression unit is formed in a recess in the second plate portion.

2. The compressor of claim 1, wherein the first scroll comprises:

a first plate portion;

a first wrap portion formed to be protruded at a predetermined height at one side of the first plate portion to constitute the first compression unit; and a piston portion formed at the first plate portion to constitute the second compression unit along with the vane.

3. The compressor of claim 2, wherein the piston portion is formed at a different height from that of the first wrap portion.

4. The compressor of claim 2, wherein at least part of the piston portion is formed to be overlapped with the first wrap portion on the same plane.

5. The compressor of claim 2, wherein the piston portion further comprises a bearing portion extended from the piston portion in an outer circumferential surface direction to constitute a bearing surface along with the second scroll.

6. The compressor of claim 2, wherein a shaft coupling portion into which the crankshaft is inserted is formed on the first plate portion, and the shaft coupling portion has a height at least part of which is overlapped with the second compression unit in an axial direction.

7. The compressor of claim 6, wherein an eccentric portion inserted into the shaft coupling portion is eccentrically formed on the crankshaft with respect to the rotational center of the crankshaft.

8. The compressor of claim 2, wherein a boss portion protruded from an opposite surface of the first wrap portion and coupled to the crankshaft is formed on the first plate portion.

9. The compressor of claim 8, wherein a boss coupling groove into which the boss portion is inserted is formed on the crankshaft, and the boss coupling groove is eccentrically formed with respect to the rotational center of the crankshaft.

10. The compressor of claim 9, wherein a bush bearing is provided on an outer circumferential surface of the boss portion or an inner circumferential surface of the boss coupling groove, the bush bearing is made of a plastic material having an ether ketone linkage, and wherein the bush bearing is formed in an annular cross-sectional shape.

11. The compressor of claim 1, wherein the compression space portion is formed at a different height from that of the second wrap portion.

12. The compressor of claim 1, wherein the second scroll is formed with a first inlet port and a first outlet port communicated with the first compression unit, and a second inlet port and a second outlet port communicated with the second compression unit, respectively.

13. The compressor of claim 12, wherein the first inlet port is directly connected to a suction pipe passing through the container, and the second outlet port is communicated with an internal space of the container.

14. The compressor of claim 13, wherein a middle cover having a predetermined internal space is coupled to the second scroll to communicate the first outlet port with the second inlet port.

15. The compressor of claim 12, wherein a suction pipe passing through the container is directly connected to the first inlet port, and the first outlet port and second inlet port are communicated with an internal space of the container, and a discharge pipe passing through the container is directly connected to the second outlet port.

16. The compressor of claim 12, wherein the first inlet port is communicated with an internal space of the container, and the second outlet port is directly connected to a discharge pipe passing through the container.

17. The compressor of claim 16, wherein a middle cover having a predetermined internal space is coupled to the second scroll to communicate the first outlet port with the second inlet port.

18. The compressor of claim 2, wherein at least one of a vane side contact surface and a piston side contact surface brought into contact with the vane and piston portion is formed in a planar shape.

19. The compressor of claim 18, wherein both the vane side contact surface and piston side contact surface are formed in a planar shape, and the width ($W_P$) of the piston side contact surface satisfies the following equation:

$$2\epsilon - W_V < W_P \leq 2\epsilon + W_V,$$

wherein an orbiting radius of the first scroll is $\epsilon$ and a width of the vane side contact surface brought into contact with the piston portion is $W_V$.

* * * * *